United States Patent [19]

Rea et al.

[11] 4,160,132

[45] Jul. 3, 1979

[54] ELECTROMAGNETIC ACOUSTIC TRANSDUCER WITH ITS AIR GAP ESTABLISHED AT ASSEMBLY BY COUNTERACTING SPRINGS

[75] Inventors: Irvin B. Rea, Royal Oak; Juhan Telmet, Fraser, both of Mich.

[73] Assignee: Lectron Products, Inc., Troy, Mich.

[21] Appl. No.: 917,174

[22] Filed: Jun. 20, 1978

[51] Int. Cl.[2] ..... H04R 13/00

[52] U.S. Cl. ..... 179/114 R; 340/391

[58] Field of Search ..... 179/114 R, 115 R; 340/391

[56] References Cited

U.S. PATENT DOCUMENTS

| | | | |
|---|---|---|---|
| 228,825 | 6/1880 | Lockwood et al. | 179/115 R |
| 1,570,287 | 1/1926 | Sell | 179/115 R |
| 2,794,862 | 6/1957 | Topholm | 179/114 R |

*Primary Examiner*—George G. Stellar

*Attorney, Agent, or Firm*—Harness, Dickey & Pierce

[57] ABSTRACT

A tone generator having a diaphragm and an electromagnet for vibrating the diaphragm to produce sound, the bobbin of the electromagnet being held in a fixed, predetermined relation to the diaphragm and connected to the retaining ring which holds the diaphragm by resilient spring arms that are stressed automatically by assembly of the tone generator to clamp the diaphragm, the pole piece of the electromagnet being held by flexible and resilient supports that are flexed automatically to retain the pole piece when the generator is assembled and to hold an end of the pole piece precisely spaced with respect to the diaphragm.

17 Claims, 1 Drawing Figure

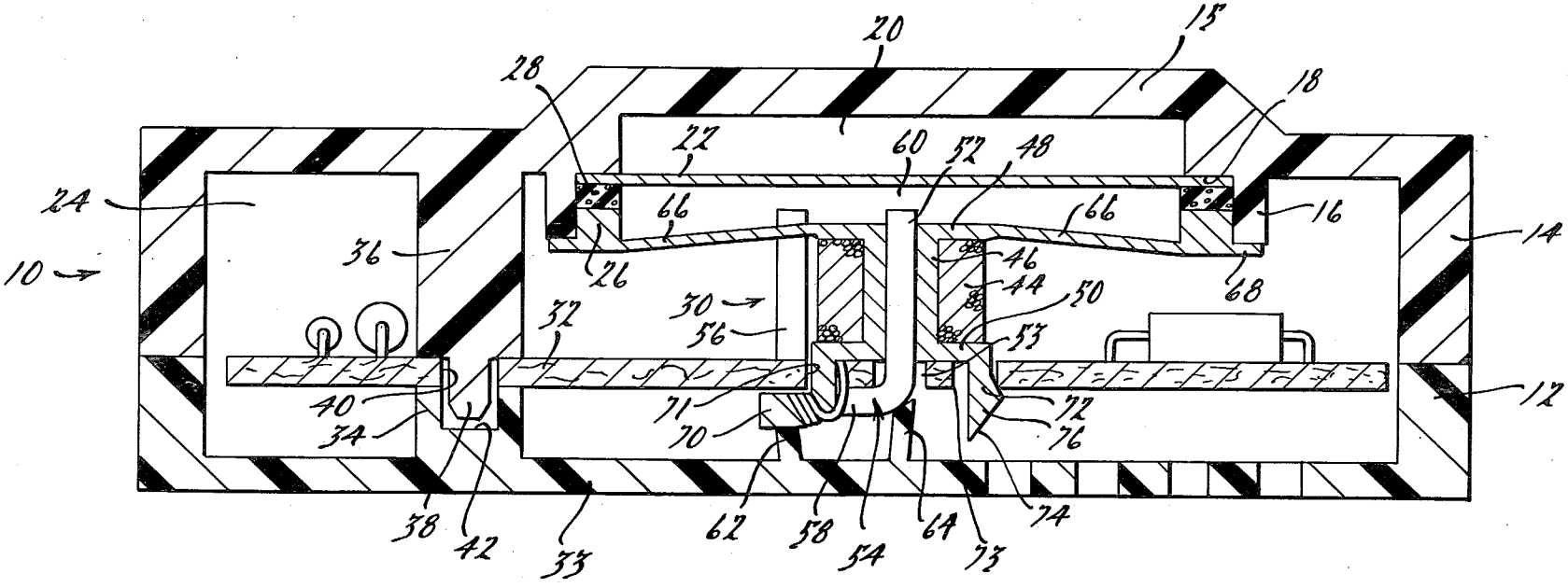
14
12
16
18
68
15
66
50
48
46
44
53
72
76
74
73
52
60
64
20
54
58
62
22
66
30
56
71
70
26
28
32
33
42
58
36
40
34
24
10

ELECTROMAGNETIC ACOUSTIC TRANSDUCER WITH ITS AIR GAP ESTABLISHED AT ASSEMBLY BY COUNTERACTING SPRINGS

BACKGROUND OF THE INVENTION

The invention of this application is an improvement on and a modification of the tone generator construction disclosed in application Ser. No. 814,417 filed July 11, 1977 and application Ser. No. 838,381 filed Sept. 30, 1977, now abandoned both assigned to the assignee of this application. In the construction disclosed in these prior applications, the diaphragm and the electromagnet are independently mounted and retained in the housing and the pole piece portion of the electromagnet is positioned with respect to and spaced from the diaphragm by frictional engagement between the pole piece and the bobbin.

SUMMARY OF THE INVENTION

The modified construction herein disclosed is essentially a redesign of the construction shown in the patent applications referred to above. The redesign eliminates some of the parts previously required or combines them into one piece so as to simplify the assembly operations and consequently to reduce manufacturing and assembly costs. The modified construction also makes certain dimensions less critical than heretofore while at the same time assuring a desired constant, low frequency sound under all conditions of use even though the device is produced by mass production methods and techniques.

DESCRIPTION OF THE DRAWING

The single view shown in the drawing is a vertical sectional view through the tone generator of this invention.

DESCRIPTION OF THE PREFERRED EMBODIMENT

The tone generator of this invention is contained in a housing 10 comprising a case 12 and a cover 14. The housing 10 contains the various operating parts of the tone generator and may be of any desired form or size. In a preferred commercial form of the invention, the housing 10 is of generally square configuration in plan and is relatively thin in side elevation. Both the case 12 and the cover 14 conveniently can be made of plastic resin material by conventional molding operations, and at final assembly the cover 14 is heat staked or otherwise fastened securely to the case 12.

Depending from the top 15 of the cover 14 and disposed centrally within the latter is an annular flange 16 which surrounds an annular shoulder 18. The portion of the cover 14 within the flange 16 and behind the annular shoulder 18 defines a primary sound cavity 20.

A flexible diaphragm 22 extending across the cavity 20 and disposed with the peripheral marginal portion thereof on the shoulder 18 closes the cavity and separates the latter from the rest of the interior of the housing which comprises a secondary sound cavity 24. The seated marginal portion of the diaphragm 22 is clamped or held against the shoulder 18 by a retaining ring 26 and a gasket 28. Retaining ring 26 fits snugly but slidably within the annular flange 16, and the gasket 28 which is made of a porous plastic material is interposed between the retaining ring and the diaphragm 22.

The diaphragm 22 is caused to vibrate to produce a desired sound by an electromagnet 30 which is mounted on and carried by a printed circuit board 32 disposed in the secondary sound cavity 24 parallel to and spaced from the top and bottom of the housing 10. In practice, the circuit board 32 is confined between and held by a plurality of post elements 34 extending upwardly from the bottom 33 of the case 12 and complementary opposed post elements 36 extending downwardly from the top 15 of the cover 14. Studs 38 on the post elements 36 extend through openings 40 provided in the board 32 and into recesses 42 in the post elements 34. The studs 38 position the board 32 at final assembly and the post elements 34 and 36 cooperate at that time to clamp the board 32 securely therebetween and they also determine the spatial relation between the board and the diaphragm 22. If desired, the outer marginal portion of the board 32 can be additionally held between the case 12 and the cover 14, but in tone generators of relatively small size of the type here shown, the peripheral portion of the board does not require additional support and it can be spaced inwardly at its edges from the housing as shown in the drawing. This is desirable under normal circumstances since it simplifies the construction of the housing and facilitates the final assembly operation.

The electromagnet 30 comprises the usual coil 44 wound on a bobbin or spool 46. The spool 46 has a top flange 48 and a bottom flange 50. One leg 52 of a U-shaped pole piece 54 extends upwardly through an opening 53 in the board 32 and on through the center passage of the spool 46. The other leg 56 of the pole piece 54 extends upwardly through another hole (not shown) in the board 32, alongside and laterally outwardly from the coil 44, and on through the top flange 48. The bight portion 58 of the pole piece 54 bears upwardly against the board 32 so that the bottom of the board serves as a reference from the gap 60 between the pole piece and the diaphragm 22 and eliminates the necessity of providing and using a separate gapping fixture heretofore required to assure a proper gap dimension.

The gap 60 determines the loudness of the sound emitted by the tone generator and, in order for the sound emitted by different tone generators produced by mass production methods to be reasonably uniform, it is necessary to keep the gap dimension of all such devices to a fairly close tolerance. As suggested, this is accomplished according to the present invention by utilizing the mounting board 32 as a reference in positioning the pole piece with respect to the diaphragm 22, by locating and holding the diaphragm 22 and the board precisely in predetermined spaced apart relation, and by providing means for holding the bight portion 58 of the pole piece pressed firmly at all times against the board. In this latter connection, the case 12 is formed with a pair of spaced, parallel, upstanding, flexible and resilient supports 62 and 64 that seat against the bight portion 58 substantially at the junctures thereof with the two leg portions 52 and 56. When the various components of the device are assembled and the case and cover 12 and 14 are pressed firmly together and heat staked or otherwise solidly interconnected, the pole piece 54 seats on and spreads the two supports 62 and 64. This flexing of the supports 62 and 64 causes them to press against the pole piece 54 with force sufficient to hold the bight 58 firmly against the mounting board 32. In practice, the leg 52 fits the spool 46 with a relatively close but sliding fit so that any friction that may exist between the pole piece and the spool is not sufficient to prevent the supports 62 and 64 from bringing and holding the bight 58 firmly against the undersurface of the board 32. In this connection, it will be observed that the openings in the board 32 through which the two legs 52 and 56 extend are substantially larger than the legs so that there is no possibility of interference between the pole piece and the board that might interfere with proper positioning of the pole piece by the supports 62 and 64.

It is a feature of this invention also that the upper flange 48 of the spool 46 is connected to the retaining ring 26 by a plurality of radially outwardly extending flexible arms 66 which preferably are formed integrally and in one piece with the spool and with the retaining ring. Any desired number of the arms 66 may be employed. One commercial form of the invention has four such arms arranged in diametrically opposed, right angularly disposed relation. Each of the arms 66 preferably extends outwardly beyond the retaining ring 26 as at 68, and these extensions 68 seat against the edge of the annular flange 16 to determine the position of the retaining ring within the flange and the extent to which the foam gasket 28 is compressed by the ring. In practice, the spool 46 is sufficiently long so that, when the case 12 and cover 14 are joined together as shown in the drawing, the retaining ring 26 is projected into the annular flange 16 and against the porous gasket 28, and as the case and cover are drawn finally together, the arm extensions 68 engage the flange 16 and flex the arms 66 so that they react to press the ring 26 against foam gasket 28 to compress the latter precisely the desired amount. All of the diaphragm 22, retaining ring 26 and foam gasket 28 fit the annular flange 16 relatively closely but with sufficient space therebetween to permit air to pass readily therearound and between the primary and secondary sound cavities 20 and 24. Air leakage between the two sound chambers 20 and 24 takes place due to pressure differentials created in use and as a result of variations in ambient temperature. The foam gasket 28 retains the diaphragm 22 securely in place but maintains the seated outer marginal edge portion thereof essentially stress free so that the quality of sound is not affected by any of the conditions to which the tone generator is normally exposed or subjected in use. By reason of the particular mounting and relation of parts hereinabove described, the diaphragm 22 is permitted to move and to function as a full piston rather than as a restrained edge driver, and this further assures a desired low frequency sound of uniform intensity.

As a further aid in the manufacture and assembly of the various components of the tone generator, the lower flange 50 of the spool 46 is formed with a pair of laterally spaced, generally L-shaped, mounting legs 70 on which the terminal portions of the coil 44 are wound, as shown in the drawing. Only one of the mounting legs 70 is shown in the drawing but it will be appreciated that there are two of these legs disposed side-by-side on the flange 50. Depending portions of the mounting legs 70 extend downwardly through openings 71 provided in the mounting board 32 and other portions thereof extend laterally outwardly from the spool 46 and below the board 32 to assist in holding the electromagnet 30 assembled on the board 32. On the side of the lower flange 50 opposite the mounting legs 70 is a depending flexible and resilient, retaining leg 72 which serves as a snap fastener. The leg 72 extends through a suitable opening 73 in the mounting board 32, and it is formed with a beveled surface 74 which facilitates insertion thereof into the opening 73 after the amounting legs 70 have been engaged under the board 32. An outward projection 76 on the leg 72 at the upper end of the beveled surface 74 snaps under the board 32 at the edge of the opening 73 and serves, in cooperation with the mounting legs 70, to hold the electromagnet 30 on the board 32 at final assembly of the tone generator.

In practice, the electromagnet 30 is assembled on the printed circuit and mounting board 32 prior to positioning the latter within the housing 10. It is only necessary that the mounting and retaining legs 70 and 72 hold the electromagnet 30 assembled on the board 32 until the sub-assembly thus formed is added in the final assembly operation since the supports 62, 64 and the arms 66 thereafter function as counteracting springs which hold the various components assembled together.

Because of the unique combination and correlation of parts hereinabove described, final assembly is essentially a stacking assembly operation. Preliminary to assembly, the cover 14 is placed upside down on the assembly table. The diaphragm 22 is then dropped into the opening defined by the annular flange 16, and the foam gasket 28 is placed on the diaphragm 22. The board 32 and electromagnet 30 subassembly is then dropped onto the cover post elements 36. As the subassembly is lowered into position, the studs 38 which extend upwardly from the posts 36 serve as guides to direct the retaining ring 26 into the opening of flange 16 and onto the porous gasket 28. Thereafter, the case 12 is placed on the cover 14 and, in this operation, the studs 38 also cooperate with the recesses 42 in the case post elements 34 to orient the case on the cover with the supports 62 and 64 properly positioned with respect to the pole piece 54 and in engagement therewith. The case 12 and cover 14 are then pressed together and heat staked or otherwise fastened together with the various components assembled inside. As the case and cover come together in this final operation, the resilient arms 66 are flexed and thereafter exert a constant force urging the retaining ring 26 against the porous gasket 28. At the same time, the extensions 68 seat on the edge of the annular flange 16 to limit the amount of pressure exerted by the retaining ring 26 on the gasket 28 and thus assure uniform compression of the gasket in all tone generators made in accordance with the present invention. Uniform compression of the gasket 28 in turn assures uniform loading of the clamped edge of the diaphragm 22 and a constant predictable movement of the diaphragm and of the sound produced thereby in use. The final assembly step of fastening the case 12 and cover 14 together also flexes the resilient supports 62 and 64 so that the latter thereafter exert a constant force against the pole piece 54 which holds the latter pressed solidly against the mounting board 32. This in turn determines the spacing between the diaphragm 22 and the pole piece 54 since the undersurface of the mounting board 32 is used as a reference for positioning the pole piece 54. Further, since the spacing between the diaphragm 22 and the mounting board 32 is uniform in all tone generators embodying the present invention, the gap 60 will be the same in all of these devices and the intensity of the sound produced thereby also will be the same.

In addition to the foregoing, it will be readily apparent that the unique construction and correlation of parts hereinabove described maintains the number of parts at a minimum, reduces the cost of the assembly, and facilitates and expedites the entire assembly operation.

Having thus described out invention, we claim:

1. In a tone generator of the type having a housing provided with primary and secondary sound cavities and an annular seat at the juncture of said cavities, a diaphragm separating said cavities disposed with the peripheral marginal portion thereof supported by said annular seat, and retaining means overlaying the marginal portion of said diaphragm and said seat, the improvement comprising mounting means in said secondary sound cavity including a board element connected to said housing and positioned thereby a pedetermined distance from said diaphragm, and electromagnetic means for vibrating said diaphragm carried by said mounting means, said electromagnetic means including a bobbin disposed between said diaphragm and said board element and detachably fastened to the latter, and a pole piece extending through said bobbin and engaging said board element to locate an end of said pole piece spaced precisely a predetermined distance from said diaphragm, and resilient means interconnecting said bobbin and said retaining means adapted to be flexed automatically at assembly of said tone generator, flexure of said resilient means urging said retaining means toward said seat whereby to clamp and hold the marginal portion of said diaphragm and simultaneously holding the bobbin in secure engagement with said board.

2. The combination as set forth in claim 1 wherein said resilient means comprises radially extending flexible arms formed integrally and in one piece with said bobbin and said retaining means.

3. The combination as set forth in claim 1 wherein said housing comprises interconnected case and cover portions and wherein said board element is held and positioned in said secondary cavity precisely with respect to said diaphragm by cooperating portions of said case and said cover.

4. The combination as set forth in claim 1 wherein said pole piece extends through and projects from said board element and the projecting portion thereof bears on said board element to position the mentioned end of the pole piece spaced precisely from said diaphgram.

5. The combination as set forth in claim 4 including resilient means interposed between said housing and the projecting portion of said pole piece engaging and holding the latter against said board element and maintaining the mentioned end of said pole piece in its precise spaced relation to said diaphragm.

6. The combination as set forth in claim 5 wherein said resilient means is in the form of spaced, flexible supports extending from said housing and engaging the projecting portion of said pole piece, said flexible supports adapted to be brought into engagement with said pole piece at assembly and to be flexed from their free state when the various components of the tone generator are assembled together, whereby to hold said pole piece securely against said board element so long as said components remain assembled.

7. The combination as set forth in claim 1 wherein said housing has interconnected case and cover portions, wherein said annular seat is formed on said cover, wherein said board element is clamped between cooperating portions of said case and said cover and held thereby precisely in predetermined, spaced relation with respect to said seat and said diaphragm, wherein said resilient means is formed integrally and in one piece with said bobbin and said retaining means, and wherein said bobbin extends toward said diaphragm a sufficient distance so that said resilient means are flexed at assembly to bring said retaining means into clamping relation to said diaphragm and said seat.

8. The combination as set forth in claim 7 wherein a portion of said pole piece is in contact with a side of said board element remote from said diaphragm, whereby said board element provides a reference location for positioning the mentioned end of said pole piece spaced precisely a predetermined distance from said diaphragm, and including means rendered operative by assembly of the board element between the case and cover portions of said housing for holding the mentioned portion of said pole piece solidly against said board element.

9. The combination as set forth in claim 8 wherein the means for holding said pole piece against said board element is in the form of flexible and resilient supports extending from said housing, said supports adapted to be flexed from their free state at assembly and being operative thereafter to maintain a constant resilient force against said pole piece to hold the latter solidly against said board element.

10. The combination as set forth in claim 1 including an annular porous element disposed between said seat and said retaining element and in engagement with the peripheral marginal portion of said diaphragm, said resilient means urging said retaining element in the direction of said seat and holding said porous element under substantially uniform compression.

11. In a tone generator of the type having a housing formed by interconnected case and cover portions and provided with primary and secondary sound cavities separated by a diaphragm, the improvement comprising mounting means detachably held between cooperating portions of said case and said cover and disposed thereby in predetermined spaced relation with respect to said diaphragm, electromagnetic means including a bobbin and a pole piece, said bobbin being detachably fastened to said mounting means and having diaphragm retaining means associated therewith adapted to move automatically at assembly into operative clamping association with said diaphragm, said pole piece engaging said mounting means and positioned by the latter precisely in predetermined spaced relation with respect to said diaphragm, and resilient means interacting between said housing and said pole piece holding the latter in engagement with said mounting means and in precise spaced relation with respect to said diaphragm.

12. The combination as set forth in claim 11 wherein said resilient means comprises flexible supports integral with and extending from said housing, said supports adapted to engage and to be flexed by said pole piece to hold the latter solidly in engagement with said mounting means when said mounting means is assembled with the case and cover portions of said housing.

13. In a tone generator of the type having a housing, a diaphragm in said housing defining separate primary and secondary sound cavities at opposite sides thereof, mounting means in said secondary sound cavity, and electromagnetic means carried by and detachably fastened to said mounting means, said electromagnetic means including a bobbin and a pole piece and being disposed with said pole piece in operative association with said diaphragm to vibrate the latter, the improvement comprising counteracting spring means associated with said bobbin and said pole piece, respectively, one of said spring means coacting with and acting through said bobbin to hold said electromagnetic means securely assembled with said mounting means, the other of said spring means coacting with said pole piece to hold the latter spaced a predetermined distance from said diaphragm to assure a desired quality of sound from the vibration of said diaphragm.

14. The combination as set forth in claim 13 wherein said one spring means interacts between said bobbin and said housing, and wherein said other spring means interacts between said pole piece and said housing.

15. The combination as set forth in claim 14 wherein said housing has interconnected portions assembled together to form said housing, and wherein said counteracting spring means cooperate with different portions of said housing and are stressed automatically by assembly of said portions to exert pressure on said bobbin and said pole piece.

16. The combination as set forth in claim 15 wherein said one spring means is in the form of flexible and resilient radial arms extending between said bobbin and one portion of said housing, and wherein said other spring means is in the form of flexible and resilient supports extending from the other portion of said housing into engagement with said pole piece.

17. The combination as set forth in claim 16 including a retaining ring for said diaphragm, and wherein said flexible and resilient radial arms are formed integrally and in one piece with said bobbin and said retaining ring, whereby the latter is moved automatically into clamping engagement with said diaphragm when the mentioned portions of said housing are assembled together.

* * * * *